US008806904B2

(12) United States Patent
Heubner et al.

(10) Patent No.: US 8,806,904 B2
(45) Date of Patent: Aug. 19, 2014

(54) WASHING MACHINE LAUNDRY DRUM

(75) Inventors: Axel Heubner, Berlin (DE); Alfred Nitsche, Berlin (DE); Uwe Ratfisch, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1607 days.

(21) Appl. No.: 12/224,002

(22) PCT Filed: Jan. 11, 2007

(86) PCT No.: PCT/EP2007/050233

§ 371 (c)(1),
(2), (4) Date: Aug. 13, 2008

(87) PCT Pub. No.: WO2007/093466

PCT Pub. Date: Aug. 23, 2007

(65) Prior Publication Data

US 2010/0223963 A1 Sep. 9, 2010

(30) Foreign Application Priority Data

Feb. 15, 2006 (DE) ..... 10 2006 007 066

(51) Int. Cl.
*D06F 37/04* (2006.01)
*D06F 37/06* (2006.01)

(52) U.S. Cl.
CPC ..... *D06F 37/04* (2013.01); *D06F 37/06* (2013.01)
USPC ..... 68/142; 68/24

(58) Field of Classification Search
USPC ..... 68/24, 58, 139, 142, 143
See application file for complete search history.

(56) References Cited

U.S. PATENT DOCUMENTS

| | | | | |
|---|---|---|---|---|
| 5,746,070 | A * | 5/1998 | Bailey et al. | 68/24 |
| 6,935,143 | B2 * | 8/2005 | Nitsche | 68/142 |
| 7,836,607 | B2 * | 11/2010 | Kim | 34/595 |
| 2004/0129036 | A1 * | 7/2004 | Ratfisch | 68/142 |
| 2005/0005654 | A1 | 1/2005 | Nitsche | |
| 2005/0126034 | A1 * | 6/2005 | Jeong et al. | 34/602 |
| 2005/0252254 | A1 * | 11/2005 | Kim | 68/142 |

FOREIGN PATENT DOCUMENTS

| | | |
|---|---|---|
| DE | 198 21 366 | 8/1999 |
| EP | 0 395 859 | 11/1990 |
| EP | 1 505 188 | 2/2005 |
| JP | 9-225176 | 9/1997 |
| WO | WO 01/61098 | 8/2001 |

OTHER PUBLICATIONS

International Search Report PCT/EP2007/050233, May 3, 2007.

* cited by examiner

*Primary Examiner* — Joseph L Perrin
(74) *Attorney, Agent, or Firm* — James E. Howard; Andre Pallapies

(57) ABSTRACT

The laundry drum is configured for removing water from wet laundry at a high rotational speed and has a circulating drum cover which is bent from a thin-walled material strip to form a cylinder or flat truncated cone wherein the parallel end edges of the material strip make contact in a connecting seam, with an assembly for connecting the end sections including a first tab formed at a first end section and continuing over the general curvature of the drum cover, a second tab formed at a second end section wherein the second tab is at least one of outwardly creased about the wall thickness of the material strip and inwardly creased about the wall thickness of the material strip wherein the tabs of the end sections are fixedly connected to one another and the overlapping tabs on the inside of the drum cover are covered.

22 Claims, 4 Drawing Sheets

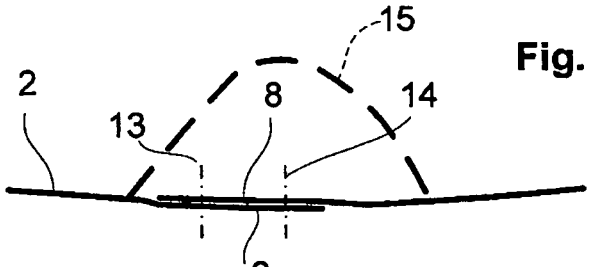
Fig. 3
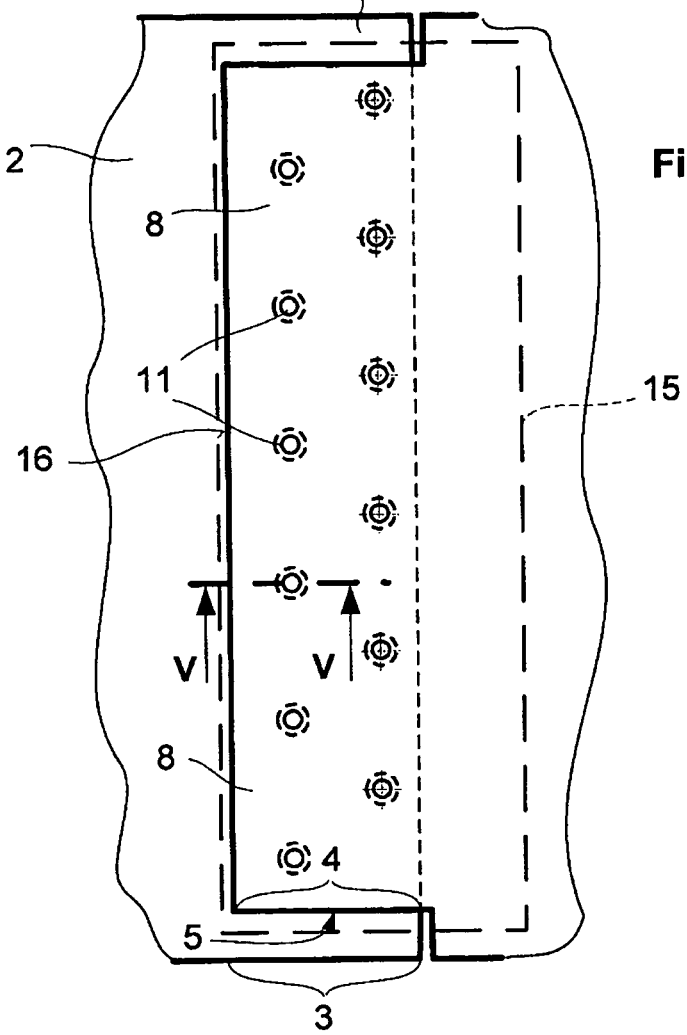
Fig. 4
Fig. 5
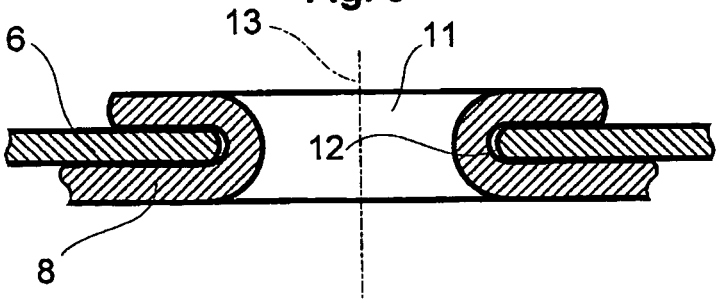

WASHING MACHINE LAUNDRY DRUM

BACKGROUND OF THE INVENTION

The invention is based on a washing machine laundry drum, which is set up to remove water from wet laundry at high revolutions and has a circulating drum shell which is bent from a thin-walled material strip to form a cylinder or flat truncated cone with a small cone angle (≤approximately 15°) in such a way that the end sections of the material strip make contact in a connecting seam.

A laundry drum of this type is known from EP 0 395 859 B1. This laundry drum indicates a conventionally used connecting seam, with which the end edges of the drum shell strip are bent and interlock with one another and are formed by an additional crimping such that the interlocked end edges cannot detach from one another. Laundry drums with a connecting seam embodied in this way are suited to removing water at high revolutions with spinning speeds of up to 1000 rpm. EP 0 395 859 B1 also proposes providing the connecting seam with step-shaped embossings disposed at right angles thereto, so as thus to render the seam stable such that laundry drums formed in this way are suited to spinning revolutions of up to approximately 1500 rpm. For laundry drums which are to be operated with even higher spinning speeds, additional measures must be taken to inhibit the tractive forces in the drum cover from becoming sufficiently large to prevent the seamed and embossed connecting seam from tearing.

In a further laundry drum of this type in DE 101 63 186 C1, the end sections comprise a crenellated toothing system, the teeth of which engage in each case in the tooth gap of the mating end edge and are formed in such a way that the base lines of the tooth gaps butting against one another form an at least approximately straight line and the teeth abut in the non-toothed region of the end sections outside the drum above the material strip and are connected fixedly there to the region. Although this type of connecting seam fulfills all the technical objectives set, it may however be too expensive in one or the other case since both end sections have to be cut relatively precisely in a toothed manner in order to achieve the desired stability. Furthermore, a tool for such edge formation is more expensive than for smooth cuttings and wears more quickly.

BRIEF SUMMARY OF THE INVENTION

The object underlying the invention is to provide a connecting seam in the case of a laundry drum of the type mentioned in the introduction which likewise withstands tractive shell forces, which occur with speeds above 1500 rpm. However, the realization of such a connecting seam is to be possible without any great effort, in particular tool outlay. The desired construction should also leave several possibilities open in terms of the choice of the connecting technology.

In accordance with the invention, this object is achieved in that the one end section has a tab which continues over the general curvature of the drum shell, rests from the drum exterior against a tab of the second end section and the tab is outwardly crimped maximally about the wall thickness of the material strip and/or inwardly crimped maximally about the wall thickness of the material strip such that the tabs of the end sections are fixedly connected to one another and the overlapping tabs are covered by a lifter on the inside of the drum shell. Depending on the choice of the connecting technology, a connecting seam embodied in this way can meet the requirements in terms of the tensile strength of the drum shell and its connections to the base disks in the rpm ranges of up to 1500 rpm and more. A high stability can be achieved by way of numerous connecting elements along the connecting seam, said stability withstanding tensile cover strengths of four times higher than with laundry drums of the prior art.

By comparison with the laundry drums known from DE 101 63 186 C1, the solution described here is advantageous in that the end sections can be cut precisely, which significantly simplifies and reduces costs in terms of the tool required herefor. Such simpler tools are also more stable, which also benefits the reduction in terms of material outlay. However, in comparison with the laundry drum from DE 101 63 186 C1, the cutting edge of the one end section pointing inside the drum is to be protected from making contact with laundry. As lifters are to be already attached inside the laundry drum, the drum designer may not be confronted with any problems in terms of attaching this sharp cutting edge by attaching a laundry lifter precisely over the overlapping end sections.

Advantageous developments of the invention are described in the subclaims and can be used individually or in any combinations with one another.

It is thus possible for the connection of the end sections of the inventive laundry drum to consist of at least a row of rivets along the extension of the end sections or of at least a welded seam. The welded connection may comprise at least one spaced spot weld. With another advantageous embodiment of the invention, the connection of the end sections can consist of a bonded joint or the end sections may be screwed to one another.

An inventive connecting seam may particularly advantageously be developed here such that the connection consists of a combination of connection types.

Rivets can be shown particularly easily, if they are formed from tubular protrusions directed outside or inside the drum on at least one of the end sections. It may even result in the stability being increased if the protrusions in each row are attached alternately to the one end section and to the other end section.

It is hugely advantageous, particularly with a truncated-cone shaped laundry drum, if the lifter follows a curved line with its longitudinal extension and the end edges of the end sections are at least approximately parallel to one another. In this way, they are able to follow a similar curved line as the lifter.

BRIEF DESCRIPTION OF THE DRAWINGS

The invention is described in more detail below with reference to an exemplary embodiment illustrated in the drawings, in which;

FIG. 3 shows a smaller representation of the cross-sectional details of the drum seam shown in FIG. 2, FIG. 4 therebelow shows a view of the connected connecting seam viewed from the inside of the drum, FIG. 5 shows a cross-section through a rivet on the connecting seam according to FIG. 4.

DETAILED DESCRIPTION OF THE PRESENT INVENTION

Figure 1:
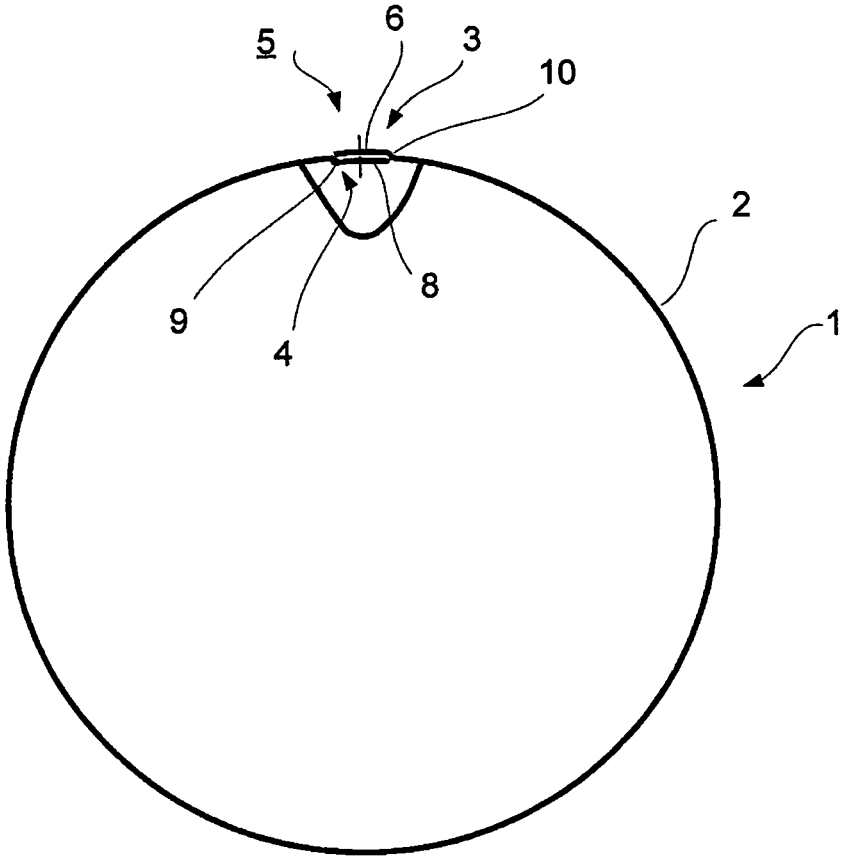
FIG. 1 shows a vertical section through a laundry drum with a connecting seam according to the invention.

The laundry drum 1 shown in FIG. 1 has a circulating drum shell 2, which is bent from a thin-walled material strip to form a cylinder. The tool may conventionally be high-grade sheet steel. The end edges 3 and 4 of the bent cylinder are joined to a connecting seam 5 (shown significantly enlarged in FIG. 2), which has two tabs 6 and 8 arranged one above the other, of which the upper tab 6 reaches a step line 9 of the lower tab 8 and the lower tab 8 reaches a step line 10 of the upper tab 6.

Figure 2:
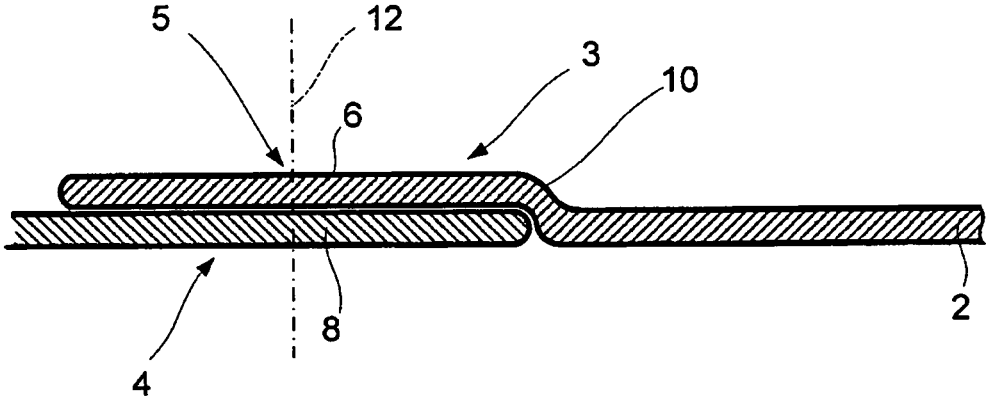
FIG. 2 shows an enlarged cross-sectional representation of the inventive connecting seam according to detail II in FIG. 1.

In accordance with the invention, in FIG. 2 the connecting seam 5 is formed by means of two tabs 6 and 8 of the drum shell 2 arranged one above the other and embodied in the end sections 3 and 4. The tabs 6 and 8 can be connected to one another in any way, e.g. by a row of rivets (not shown) along the center axis 12. The seam can also be embodied as a welded seam, in particular as a spaced spot weld, in order to establish a high stability of the seam 5. A bonded joint of tabs arranged one above the other for joining to the seam can however also be provided, with a whole-surface bonded joint being preferable. After connection, the seam is to be covered from the inside (by means of a lifter, cf. FIG. 3), so that the laundry is protected against contact with sharp edges of the end sections. However, in the example in FIG. 2, deviating from the example in FIG. 1, only the upper end section 3 is stepped at a tab 6, which covers the lower, non-stepped end section 4.

FIG. 3 shows a seam joined according to FIG. 2, in which the tabs 6 and 8 are connected to one another by means of two rows 13 and 14 of rivets 11. FIG. 4 shows the joined seam 5 as viewed from inside the drum shell 2. It is apparent that the tabs 8 come to rest on the outside of the drum shell 2 and the inside except for the rivet 11 remains completely smooth. As according to the dashed contour 15 a lifter (only indicated) covers the overlapping region, the edge 16 of the interior tab 6 is also covered so that any sharpness that is still present at these edges 16 is harmless to the laundry.

The rivets 11 can also be configured according to FIG. 5 (enlarged sectional representation according to sectional lines V-V in FIG. 4) such that they do not attach to the inside of the drum shell 2. Here the tubular rivets are formed from a tubular protrusion in the region of the tab 8, said tubular rivets extending through a hole 12 in the tab 6 and being bent behind said tab. The inner diameter of such a pass-through rivet 11 is logically not selected to be greater than the diameter of the flood holes (not shown here) which are otherwise still present in the drum shell 2.

If the connecting seam 5 according to FIGS. 4 and 5 is not to be configured to be completely smooth on the inside of the drum shell 2, as already indicated above, the arrangement of an already required lifter 15 (FIGS. 3 and 4) on the inside of the drum shell 2 precisely over the seam 5 can prevent the laundry lying within the laundry drum from making contact with the sharp-edged bumps.

Figure 6:
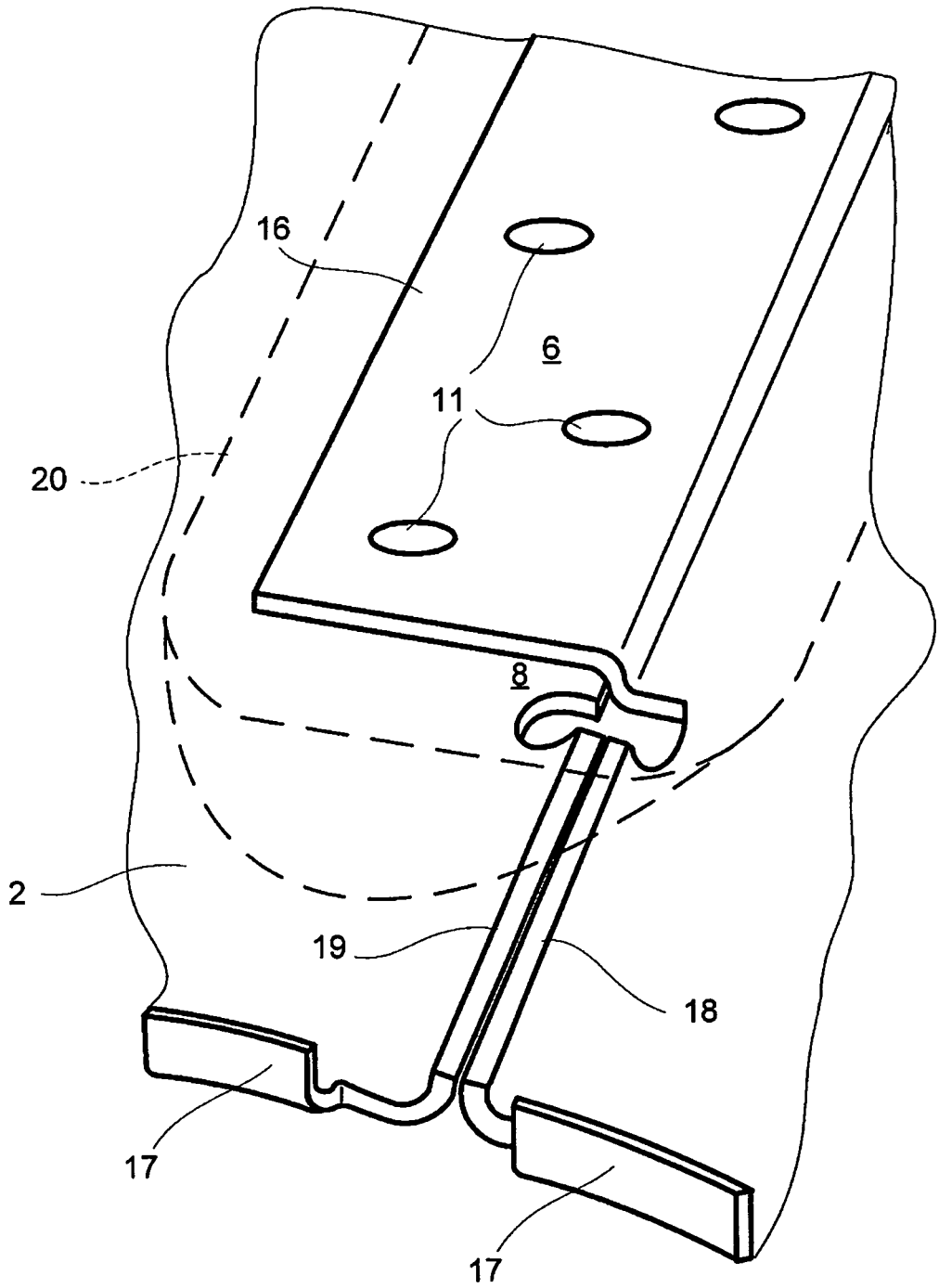
FIG. 6 shows a view of a connecting seam, which does not reach the edges of the drum shell.

The overlapping connection 16 shown in FIG. 6 does not extend beyond the entire depth of the laundry drum. A fixed connection need not exist between the tabs 6 and 8 in the vicinity of the drum disk or base disk, which is connected to the drum shell 2 by way of a double flanged seam, of which the sheet flange 17 of the drum shell 2 is shown. The connecting forces from the lateral connection are applied here by the respective double flanged seam (sheet flange 17) and the front edges 18 and 19 of the drum shell 2 which lie adjacent to the tabs 6 and 8 are expediently beveled outside the drum. As a result, sharp edges inside of the drum are prevented. The region shown by the overlapping connection 16 and potentially provided with sharp edges is then already covered by lifters 20. This embodiment is advantageous in this respect as the (covering) lifters do not as a result have to completely reach the base and drum disks. The connection 16 itself can be produced in any fashion, by means of rivets, welding, screws or jointed bonds.

Figure 7:
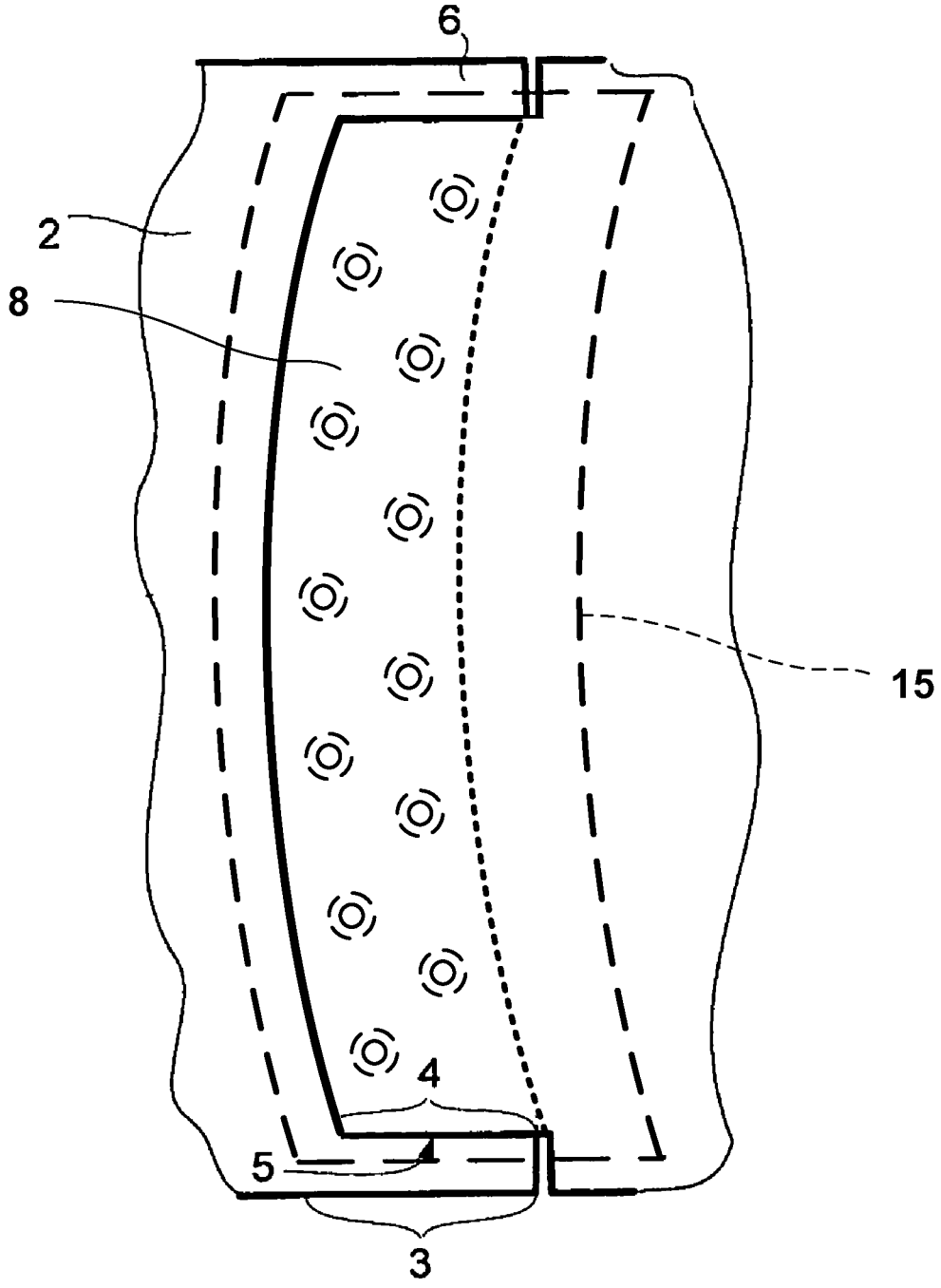
FIG. 7 shows a view of an alternate embodiment of the connected connecting seam viewed from inside the drum.

As shown in FIG. 7, the end sections 3 and 4 and/or the tabs 6 and 8 formed therein can, in the case of a potentially curved bending line of the lifter, be molded in a curved line which runs parallel thereto. In other respects, the geometry of the remaining parts of the connecting seam 16, as far as they have to be adjusted to the joint, is retained.

The invention is not restricted to the exemplary embodiment illustrated. The connecting seam 5, as the case may be, does not necessarily have to be at right angles to the side edge of the drum shell 2. However, it is worth checking whether an asymmetrical configuration of the tabs is better suited to the incline of the connecting seam 5 than the symmetrical configuration shown here. The drum shape can also deviate from the cylinder, which may likewise influence the shape of the tabs.

The invention claimed is:

1. A washing machine laundry drum configured for removing water from wet laundry at a high rotational speed, the drum comprising:

a rotating drum shell which is formed from a thin-walled material strip to form at least one of a cylinder and a flat truncated cone with a cone angle less than or equal to about 15° in a manner wherein first and second end sections of the material strip make contact along a connecting seam, a connection along the connecting seam that connects the end sections, the connection including a first tab formed at the first end section of the material strip, the first tab being curved such that the first tab follows a general curvature of the cylindrical or truncated cone shape of the drum shell, the first tab being a continuation of the material strip such that the first tab and the material strip follow an unstepped curved line;

a second tab formed at the second end section of the material strip wherein the second tab is one of outwardly stepped an amount of about the wall thickness of the material strip and inwardly stepped an amount of about the wall thickness of the material strip; and a lifter that covers the connecting seam, wherein the tabs of the end sections overlap and are directly fixedly connected to one another where they overlap, and the tabs are covered by the lifter on the inside of the drum shell where they overlap.

2. A laundry drum according to claim 1, wherein the connection that connects the end sections includes at least a row of rivets along the extension of the end sections.

3. The laundry drum according to claim 1, wherein the connection that connects the end sections includes at least one welded seam.

4. The laundry drum according to claim 1, wherein the connection that connects the end sections includes a bonded joint.

5. A washing machine according to claim 1, wherein the tabs are screwed to one another.

6. The laundry drum according to claim 2, wherein the rivets are formed from tubular protrusions directed against the tabs arranged opposite to one another on at least one of the tabs.

7. The laundry drum according to claim 6, wherein the protrusions in each row are alternately attached to the one tab and the other tab.

8. The laundry drum according to claim 3, wherein the welded connection includes at least one spot weld seam.

9. The laundry drum according to claim 2, wherein the connection that connects the end sections includes a combination of connection types.

10. The laundry drum according to claim 1, wherein the lifter extends along a curved line and edges of the tabs at least approximately follow a curved line that is generally parallel to the curved line along which the lifter extends.

11. The laundry drum according to claim 1, wherein the first tab and the second tab are the only tabs that are part of the connection of the laundry drum.

12. The laundry drum according to claim 11, wherein an edge of the first tab is a continuous straight line and an edge of the second tab is a continuous straight line.

13. The laundry drum according to claim 12, wherein the edge of the first tab continues uninterrupted along an entire length of the connecting seam, and the edge of the second tab continues uninterrupted along an entire length of the connecting seam.

14. The laundry drum according to claim 1, wherein the connection is no thicker than the sum of a thickness of the first tab and a thickness of the second tab.

15. The laundry drum according to claim 14, wherein the connection is no thicker than twice a thickness of the material strip.

16. A washing machine laundry drum configured for removing water from wet laundry at a high rotational speed, the drum comprising:

a rotating drum shell which is formed from a thin-walled material strip to form at least one of a cylinder and a flat truncated cone in a manner wherein first and second end sections of the material strip make contact along a connecting seam;

a connection along the connecting seam that connects the end sections, the connection including a first tab formed at the first end section of the material strip, the first tab being curved such that the first tab follows a general curvature of the cylindrical or truncated cone shape of the drum shell;

a second tab formed at the second end section of the material strip wherein the second tab is one of outwardly stepped an amount of about the wall thickness of the material strip and inwardly stepped an amount of about the wall thickness of the material strip; and a lifter that covers the connecting seam, wherein the tabs of the end sections overlap and are directly fixedly connected to one another where they overlap, the tabs are covered by the lifter on the inside of the drum shell where they overlap, and the connection is no thicker than the sum of a thickness of the first tab and a thickness of the second tab.

17. The laundry drum according to claim 16, wherein the first tab and the second tab are the only tabs that are part of the connection of the laundry drum.

18. The laundry drum according to claim 17, wherein an edge of the first tab is a continuous straight line and an edge of the second tab is a continuous straight line.

19. The laundry drum according to claim 18, wherein the edge of the first tab continues uninterrupted along an entire length of the connecting seam, and the edge of the second tab continues uninterrupted along an entire length of the connecting seam.

20. The laundry drum according to claim 16, wherein the connection is no thicker than twice a thickness of the material strip.

21. The laundry drum according to claim 16, wherein the lifter extends along a curved line and edges of the tabs at least approximately follow a curved line that is generally parallel to the curved line along which the lifter extends.

22. A method of connecting end sections of a washing machine laundry drum configured for removing water from wet laundry at a high rotational speed, the method comprising:

forming a rotating drum shell from a thin-walled material strip to form at least one of a cylinder and a flat truncated cone in a manner wherein first and second end sections of the material strip make contact along a connecting seam;

forming a connection along the connecting seam that connects the end sections, including forming a first tab formed at the first end section of the material strip, the first tab being curved such that the first tab follows a general curvature of the cylindrical or truncated cone shape of the drum shell;

forming a second tab formed at the second end section of the material strip wherein the second tab is one of outwardly stepped an amount of about the wall thickness of the material strip and inwardly stepped an amount of about the wall thickness of the material strip;

overlapping the tabs of the end sections and directly fixedly connecting the tabs to each other where they overlap; and covering the tabs with a lifter that covers the connecting seam on the inside of the drum shell, wherein the connection is no thicker than the sum of a thickness of the first tab and a thickness of the second tab.

* * * * *